US006414908B1

(12) United States Patent
Kurasawa

(10) Patent No.: US 6,414,908 B1
(45) Date of Patent: Jul. 2, 2002

(54) ELECTRONIC CLOCK AND POINTER POSITION DETECTING METHOD

(75) Inventor: Yoshimitsu Kurasawa, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/642,875

(22) Filed: Aug. 21, 2000

(51) Int. Cl.[7] ..... G04B 19/04
(52) U.S. Cl. ..... 368/80; 368/187; 368/204
(58) Field of Search ..... 368/10, 11, 76, 368/80, 107–113, 185–187, 203, 204, 223

(56) References Cited

U.S. PATENT DOCUMENTS 4,533,257 A * 8/1985 Kitano et al. ..... 368/202
5,280,459 A * 1/1994 Nakamura ..... 368/80

FOREIGN PATENT DOCUMENTS

DE 3042694 6/1981
EP 0720073 7/1996

* cited by examiner

*Primary Examiner*—Bernard Roskoski
(74) *Attorney, Agent, or Firm*—Adams & Wilks

(57) ABSTRACT

A center wheel & pinion of a wheel train is formed so that high load is applied to the wheel train when a minute hand stands at twelve o'clock. A pulse control circuit outputs a normal driving pulse. When a motor does not rotate by the normal driving pulse, the pulse control circuit outputs a first auxiliary driving pulse. Further, when the motor does not rotate by the first auxiliary driving pulse, the pulse control circuit outputs a second auxiliary driving pulse. The motor 6 normally rotates by the normal driving pulse or the first auxiliary driving pulse or rotates by the second auxiliary driving pulse when the high load is applied to the wheel train, i.e., when the minute hand stands at twelve o'clock. A pointer position detecting circuit judges that the minute hand stands at twelve o'clock when it receives the P3 output signal from the pulse control circuit, i.e., when the second auxiliary driving pulse is outputted from the pulse control circuit.

12 Claims, 10 Drawing Sheets

ELECTRONIC CLOCK AND POINTER POSITION DETECTING METHOD

BACKGROUND OF THE INVENTION

1. Field of the Invention

The present invention relates to an electronic clock and a pointer position detecting method, or more specifically to an electronic clock and a pointer position detecting method for obtaining a signal for making a specific action by detecting that a pointer has come to predetermined position.

2. Description of the prior Art

An electronic clock is arranged so as to make a specific action when a pointer comes to predetermined position. Examples of the specific action include sounding time, turning a calendar, adjusting the clock based on radio wave received from the outside, and so on. When time is to be sounded when a minute hand stands at twelve o'clock, the electronic clock outputs a time sounding signal to a circuit for sounding the time by detecting that the minute hand stands at twelve o'clock. That is, the position of the pointer must be detected in the electronic clock to make a specific action when the pointer comes to predetermined position.

As a prior art, there has been known a technology of detecting the pointer position by using a mechanical contact. In the technology of using the mechanical contact, a center wheel & pinion is provided with a projecting cam and a contact made of leaf spring facing to the center wheel & pinion. Because the contact is hooked by the cam every time when the center wheel & pinion makes a turn in a hour and oscillates between a pair of contact springs, it is judged that the minute hand has come to predetermined position (position indicating twelve o'clock for example) when the contact is hooked by the cam and a signal, e.g., a time sounding signal, for making a predetermined action is outputted.

Japanese Patent Laid-Open NoS. 55-82080 and 61-118483 and Japanese Utility Model Laid-Open No. 56-10883 have also disclosed technologies of optically detecting the pointer position. According to the technologies, gears in a wheel train is disposed so that at least a part thereof overlap each other, each gear is provided with a transparency which agrees at constant cycle, e.g., once in a hour, and a light emitting device and a light receiving device are disposed on an extension in the axial direction at the position where the respective transparencies agree. The respective transparencies agree when the light receiving device receives light from the light emitting device. Then, the clock judges that the pointer has come to predetermined position, e.g., position indicating twelve o'clock, and outputs a signal, e.g., a time sounding signal, for making a predetermined operation.

However, the method of detecting the pointer position by using the mechanical contact has had a problem that the precision of detection drops due to deterioration of the contact and the contact springs. It also has had a problem that torque of a motor must be increased because the contact becomes a rotational resistance of the wheel train, thus increasing power consumption.

Meanwhile, the method of optically detecting the pointer position has had problems that it is costly because it requires the light emitting device and the light receiving device and that it is difficult to compact the clock. It also has had a problem that its structure is complicated because the light emitting device and the light receiving device must be disposed within a narrow space. It has had another problem that its power consumption increases to operate the light emitting device and the light receiving device.

The present invention has been devised in view of the problems described above and its object is to provide an electronic clock and a pointer position detecting method for detecting the pointer position accurately without adding individual electric device.

SUMMARY OF THE INVENTION

In order to achieve the above-mentioned object, an inventive electronic clock comprises reference signal generating means for generating a reference signal; pulse control means for outputting a plurality of pulse signals whose strength is different based on the reference signal to a motor to drive the motor; a wheel train which is rotated by the motor; indicator means which is rotated by the wheel train; position detecting means for detecting predetermined position of the indicator means; and rotation judging means for outputting a rotation signal or a non-rotation signal by detecting whether or not the motor rotates. It is also provided with high load means for applying high load to the wheel train at constant cycle to rotate the motor only when the high load is applied to the wheel train and a pulse signal of predetermined strength or more is outputted to the motor; the pulse control means outputs a normal driving pulse, outputting a first auxiliary driving pulse whose strength is greater than that of the normal driving pulse when the rotation judging means outputs a non-rotation signal after outputting the normal driving pulse or outputting a second auxiliary driving pulse whose strength is greater than the first auxiliary driving pulse and the predetermined strength when the rotation judging means outputs the non-rotation signal after outputting the first auxiliary driving pulse; and the position detecting means judges that the indicator means is located at the predetermined position when the second auxiliary driving pulse is outputted.

An inventive pointer position detecting method for detecting that indicator means has come to predetermined position, comprises steps of: applying high load to a wheel train for rotating the indicator means at constant cycle so that a motor rotates only when the high load is applied and a pulse signal of predetermined strength or more is outputted to the motor for rotating the wheel train; judging whether or not the motor rotates by outputting a normal driving pulse to the motor; judging whether or not the motor rotates by outputting a first auxiliary driving pulse whose strength is greater than that of the normal driving pulse to the motor when the motor does not rotate by the normal driving pulse; outputting a second auxiliary driving pulse whose strength is greater than the first auxiliary driving pulse and the predetermined strength to the motor when the motor does not rotate by the first auxiliary driving pulse; and judging that the indicator means is located at the predetermined position when the second auxiliary driving pulse is outputted.

Japanese Patent Publication Nos. 63-18148, 63-18149 and 57-18440 have disclosed the technology of detecting that a motor rotates by outputting a relatively weak normal driving pulse to the motor for rotating a wheel train and of always rotating the motor by outputting a relatively strong auxiliary driving pulse when the motor does not rotate by the normal driving pulse. Normally, power consumption of a motor may be reduced by rotating by the normal driving pulse which consumes less power and by using the auxiliary driving pulse whose power consumption is large only when load is applied to the motor by some reason.

Then, the present invention is arranged so that high load is applied to the wheel train when the indicator means comes to predetermined position and the motor rotates only when the high load is applied and a pulse signal of predetermined strength or more is outputted to the motor. While the motor normally rotates by the normal driving pulse or a first auxiliary driving pulse, it does not rotate when high load is applied to the wheel train, so that it is rotated by applying a stronger second auxiliary driving pulse. Accordingly, it becomes possible to detect the predetermined position of the indicator means by the second auxiliary driving pulse because the second auxiliary driving pulse is outputted when the indicator means is located at the predetermined position. Still more, no light receiving device like those in the prior art is required.

For instance, when it is arranged so that high load is applied to the wheel train when the minute hand stands at twelve o'clock, the second auxiliary driving pulse for rotating the motor when the minute hand stands at twelve o'clock is required. Accordingly, the minute hand stands at twelve o'clock when the second auxiliary driving pulse is outputted.

In the electronic clock described above, the inventive electronic clock is characterized in that the position detecting means judges that the indicator means has come to the predetermined position when the rotation judging means outputs the non-rotation signal after outputting the first auxiliary driving pulse.

In the pointer position detecting method, the inventive pointer position detecting method is characterized in that the indicator means is judged to be located at the predetermined position when the motor does not rotate by the first auxiliary driving pulse.

That is, according to the invention, it is judged that the indicator means has come to the predetermined position when the motor does not rotate by the first auxiliary driving pulse. It is noted that the motor does not rotate by the first auxiliary driving pulse when the high load is applied to the wheel train. Accordingly, it means that the high load is applied to the wheel train, i.e., the indicator means is located at the predetermined position, when the motor does not rotate by the first auxiliary driving pulse. Therefore, it becomes possible to detect the pointer position by utilizing the structure necessary for operating the electronic clock.

In the electronic clock described above, the inventive electronic clock further comprises number-of-revolutions counting means for counting a number of revolutions of the motor since when the pulse control means has outputted the second auxiliary driving pulse for the first time; and number-of-revolutions judging means for outputting a control signal for outputting the second auxiliary driving pulse when the number of revolutions reaches to the number of revolutions corresponding to the cycle in which the high load is applied to the wheel train to the pulse control means.

In the pointer position detecting method described above, the inventive pointer position detecting method is characterized in that a number of revolutions of the motor is counted and the second auxiliary driving pulse is outputted when the number of revolutions reaches to a number of revolutions corresponding to the cycle in which high load is applied to the wheel train.

That is, according to the invention, the number of revolutions of the motor is counted from when the second auxiliary driving pulse is started to be outputted and when the number of revolutions reaches to the number of revolutions corresponding to the cycle in which the high load is applied to the wheel train, the second auxiliary driving pulse is outputted without outputting the normal driving pulse and the first auxiliary driving pulse. It is possible to predict when high load is applied next by counting the number of revolutions of the motor from when the second auxiliary driving pulse is outputted for the first time because the high load is applied to the wheel train at constant cycle. Accordingly, it becomes possible to output the second auxiliary driving pulse directly when the high load is predicted to be applied. As a result, it becomes possible to save power consumption required for outputting the normal driving pulse and the first auxiliary driving pulse.

For instance, when it is arranged so that high load is applied to the wheel train when the minute hand stands at twelve o'clock, the high load is applied again to the wheel train after when the motor rotates by 3600 times since when the high load has been applied to the wheel train for the first time when the motor rotates once in a second. Accordingly, it is apparent that the motor does not rotate unless the second auxiliary driving pulse is outputted when the number of revolutions of the motor reaches to 3600 since when the high load is applied to the wheel train for the first time. In this case, the second auxiliary driving pulse is outputted directly without outputting the normal driving pulse nor first auxiliary driving pulse to save the power consumption for outputting the normal driving pulse and first auxiliary driving pulse.

In the electronic clock described above, the inventive electronic clock further comprises pulse output times counting means for counting a number of output times of the second auxiliary driving pulse during when the number of revolutions of the motor reaches to the number-of-revolutions signal corresponding to the cycle in which the high load is applied to the wheel train; and pulse number judging means for outputting a control signal for stopping to generate the pulse signal to the pulse control means when the output times of the second auxiliary driving pulse exceeds a predetermined number of times.

In the pointer position detecting method described above, the pointer position detecting method is characterized in that a number of output times of the second auxiliary driving pulse is counted during when the number of revolutions of the motor reaches to the number of revolutions corresponding to the cycle in which the high load is applied to the wheel train to stop to generate the pulse signal when the number of output times exceeds a predetermined number of times.

That is, according to the invention, the number of revolutions of the motor is counted since when the second auxiliary driving pulse has been outputted for the first time and the number of output times of the second auxiliary driving pulse is counted until when the number of revolutions reaches to the number of revolutions corresponding to the cycle in which the high load is applied to the wheel train. When the number output times of the second auxiliary driving pulse exceeds a predetermined number of times, unpredictable high load is applied to the wheel train by some reason, i.e., the clock is defective. Then, it becomes possible to save power and to inform of the trouble of the clock to its user by stopping the operation of the clock by stopping the generation of the pulse signal.

For instance, when high load is to be applied to the wheel train when the minute hand stands at twelve o'clock, the high load is normally applied to the wheel train only once in an hour. When the high load is applied to the wheel train more than once in an hour here, i.e. when the number of output times of the second auxiliary driving pulse becomes 2, it can be seen that the clock is defective because there exists high load which has not been predicted in the design thereof. In such a case, it is possible to save power and to inform of the trouble of the clock to its user by stopping the operation of the clock by stopping to generate the pulse signal.

In the electronic clock described above, the inventive electronic clock further comprises pulse output times counting means for counting a number of output times of the second auxiliary driving pulse during when the number of revolutions of the motor reaches to the number-of-revolutions signal corresponding to the cycle in which the high load is applied to the wheel train; and pulse number judging means for outputting a control signal for changing output intervals of the pulse signal to the pulse control means when the output times of the second auxiliary driving pulse exceeds a predetermined number of times.

In the pointer position detecting method described above, the inventive pointer position detecting method is characterized in that a number of output times of the second auxiliary driving pulse is counted during when the number of revolutions of the motor reaches to the number of revolutions corresponding to the cycle in which the high load is applied to the wheel train to change output intervals of the pulse signal when the number of output times exceeds a predetermined number of times.

That is, according to the present invention, the number of revolutions of the motor is counted since when the second auxiliary driving pulse has been outputted for the first time and the number of output times of the second auxiliary driving pulses which are outputted during when the number of revolutions reaches to the number of revolutions corresponding to the cycle in which the high load is applied to the wheel train is counted. It is noted that when the number of output times of the second auxiliary driving pulses exceeds a predetermined number of times, unpredictable high load is applied to the wheel train by some reason, i.e., the clock is defective. Then, the pointer of the clock is caused to make abnormal operations by changing the output intervals of the pulse signal. Thereby, it is possible to inform the trouble of the clock.

For instance, when high load is to be applied to the wheel train when the minute hand stands at twelve o'clock, the high load is applied to the wheel train only once in an hour. When high load is applied to the wheel train more than once in an hour, i.e., when the number of output times of the second auxiliary driving pulse becomes 2, it can be seen that the clock is defective. In this case, the trouble of the clock is informed to its user by moving a second hand which normally moves at intervals of one second at intervals of five seconds by changing the intervals of the pulse signals.

An inventive electronic clock comprises reference signal generating means for generating a reference signal; pulse control means for outputting a plurality of pulse signals whose strength is different based on the reference signal to a motor to drive the motor; a wheel train which is rotated by the motor; indicator means which is rotated by the wheel, train; position detecting means for detecting predetermined position of the indicator means; and rotation judging means for outputting a rotation signal or a non-rotation signal by detecting whether or not the motor rotates. The electronic clock is also characterized in that it is provided with high load means for applying high load to the wheel train continuously by a plurality of times at constant cycle so that the motor rotates only when the high load is applied to the wheel train and a pulse signal of predetermined strength or more is outputted to the motor continuously by a plurality of times; the pulse control means outputs a normal driving pulse, outputting a first auxiliary driving pulse whose strength is greater than that of the normal driving pulse when the rotation judging means outputs a non-rotation signal after outputting the normal driving pulse or outputting a second auxiliary driving pulse whose strength is greater than the first auxiliary driving pulse and the predetermined strength when the rotation judging means outputs the non-rotation signal after outputting the first auxiliary driving pulse; and the position detecting means judges that the indicator means is located at the predetermined position when the second auxiliary driving pulse is outputted continuously by a plurality of times and when the rotation judging means outputs the rotation signal as the normal driving pulse or first auxiliary driving pulse is outputted after that.

In the pointer position detecting method for detecting that indicator means has come to predetermined position, the inventive pointer position detecting method comprises steps of applying high load to a wheel train for rotating the indicator means continuously by a plurality of times at constant cycle so that a motor rotates only when the high load is applied and a pulse signal of predetermined strength or more is outputted to the motor for rotating the wheel train; judging whether or not the motor rotates by outputting a normal driving pulse to the motor; judging whether or not the motor rotates by outputting a first auxiliary driving pulse whose strength is greater than that of the normal driving pulse to the motor when the motor does not rotate by the normal driving pulse; outputting a second auxiliary driving pulse whose strength is greater than the first auxiliary driving pulse and the predetermined strength to the motor when the motor does not rotate by the first auxiliary driving pulse; and judging that the indicator means is located at the predetermined position when the second auxiliary driving pulse is outputted continuously by a plurality of times and the motor rotates when the normal driving pulse or first auxiliary driving pulse is outputted after that.

That is, according to the invention, the plurality of high loads is applied continuously to the wheel train before the indicator means comes to the predetermined position and the motor rotates only when the high load is applied and pulse signals of predetermined strength or more are outputted continuously by a plurality of times. The indicator means is judged to be located at the predetermined position when the second auxiliary driving pulse is outputted continuously by a plurality of times and then the motor rotates by the normal driving pulse or the first auxiliary driving pulse. Therefore, it is possible to detect the pointer position by utilizing the structure required for operating the electronic clock.

For instance, when high load is applied to the wheel train by which the motor does not rotate unless the second auxiliary driving pulses are outputted continuously by five times 5 seconds before the minute hand stands at twelve o'clock, the second auxiliary driving pulses must be outputted continuously by five times in order to rotate the motor when the high load is applied to the wheel train and the motor rotates by the normal driving pulse or the first auxiliary driving pulse after that. Accordingly, the high load is applied to the wheel train when the second auxiliary driving pulses are outputted continuously by five times and it can be seen that the minute hand stands at twelve o'clock when the motor rotates by the normal driving pulse or the first auxiliary driving pulse.

BRIEF DESICRIPTION OF THE DRAWINGS

A preferred form of the present invention is illustrated in the accompanying drawings in which.

DETAILED DESCRIPTION OF THE PREFERRED EMBODIMENTS

An electronic clock and a pointer position detecting method of the invention will be explained below in detail by using the appended drawings.

[First Embodiment]

Figure 1:
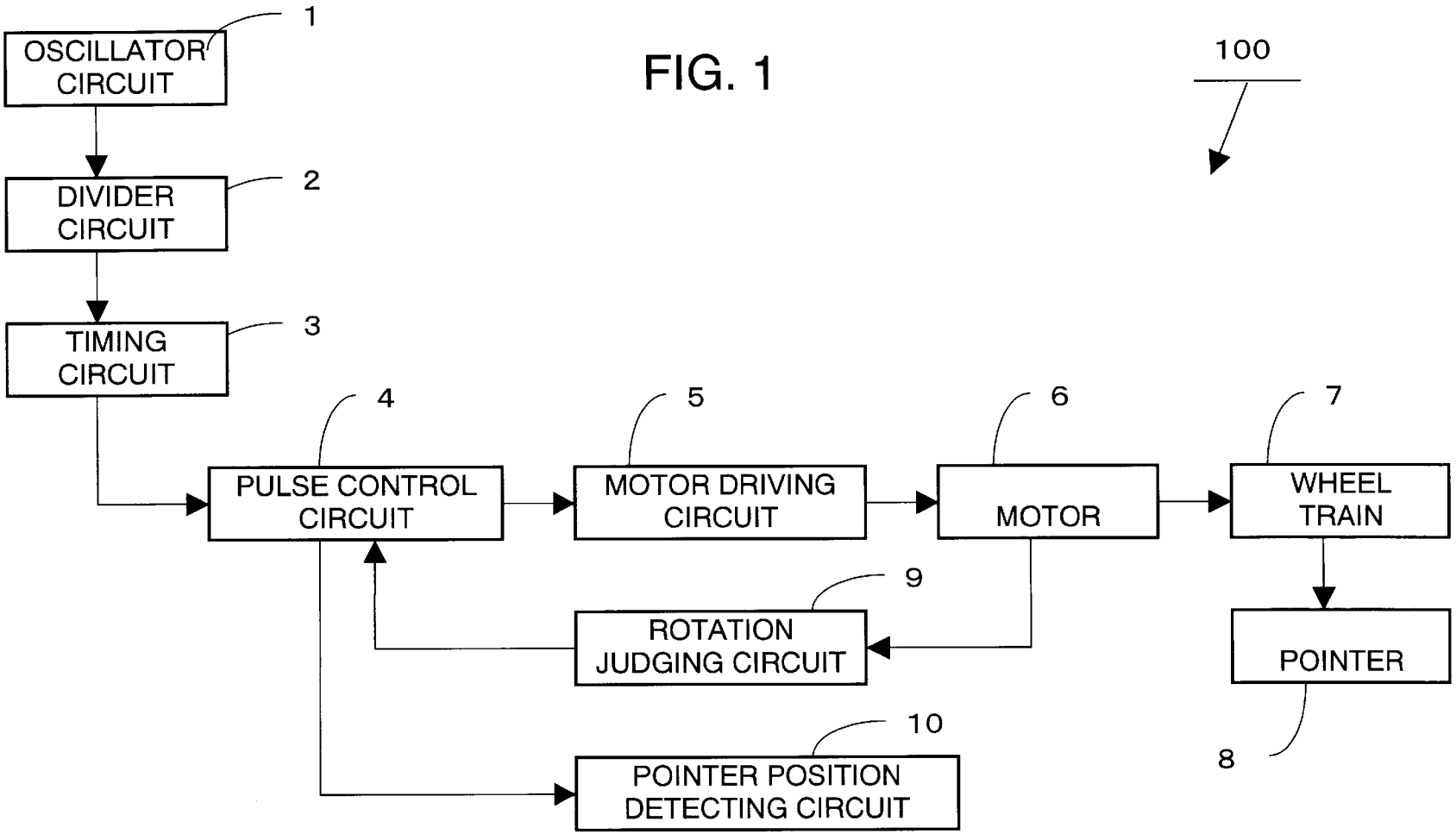
FIG. 1 is a block diagram of an electronic clock according to a first embodiment of the invention.

FIG. 1 is a block diagram of an electronic clock according to a first embodiment of the invention. The electronic clock 100 comprises a oscillator circuit 1, a divider circuit 2, a timer circuit 3, a pulse control circuit 4, a motor driving circuit 5, a motor 6, a wheel train 7, a pointer 8, a rotation judging circuit 9 and a pointer position detecting circuit 10. It is noted that the oscillator circuit 1, the divider circuit 2, the timer circuit 3, the pulse control circuit 4, the motor driving circuit 5, the rotation judging circuit 9 and the pointer position detecting circuit 10 are made in a body as one integrated circuit.

The oscillator circuit 1 oscillates a signal of 32,768 Hz which is used as a clock reference signal. The divider circuit 2 divides the reference signal into a second signal which is required for clocks. The timer circuit 3 counts the second signal. The pulse control circuit 4 generates and outputs a normal driving pulse P1, a first auxiliary driving pulse P2 and a second auxiliary driving pulse P3. It also inputs a P3 output signal indicative of that the second auxiliary driving pulse P3 is outputted when the second auxiliary driving pulse P3 is outputted to the pointer position detecting circuit 10. The motor driving circuit 5 supplies driving pulses (current based on the driving pulses in concrete) outputted from the pulse control circuit 4 to the motor 6.

The motor 6 turns the wheel train 7 and the pointer 8. The center wheel & pinion of the wheel train 7 is formed so that high load X ($2<X\leqq 3$) is applied to the wheel train 7 when the minute hand stands twelve o'clock. Thereby, the high load is applied to the wheel train 7 every time when the minute hand stands twelve o'clock. The high load may be added by changing the shape of teeth of the center wheel & pinion or passing the cam.

Figure 2:
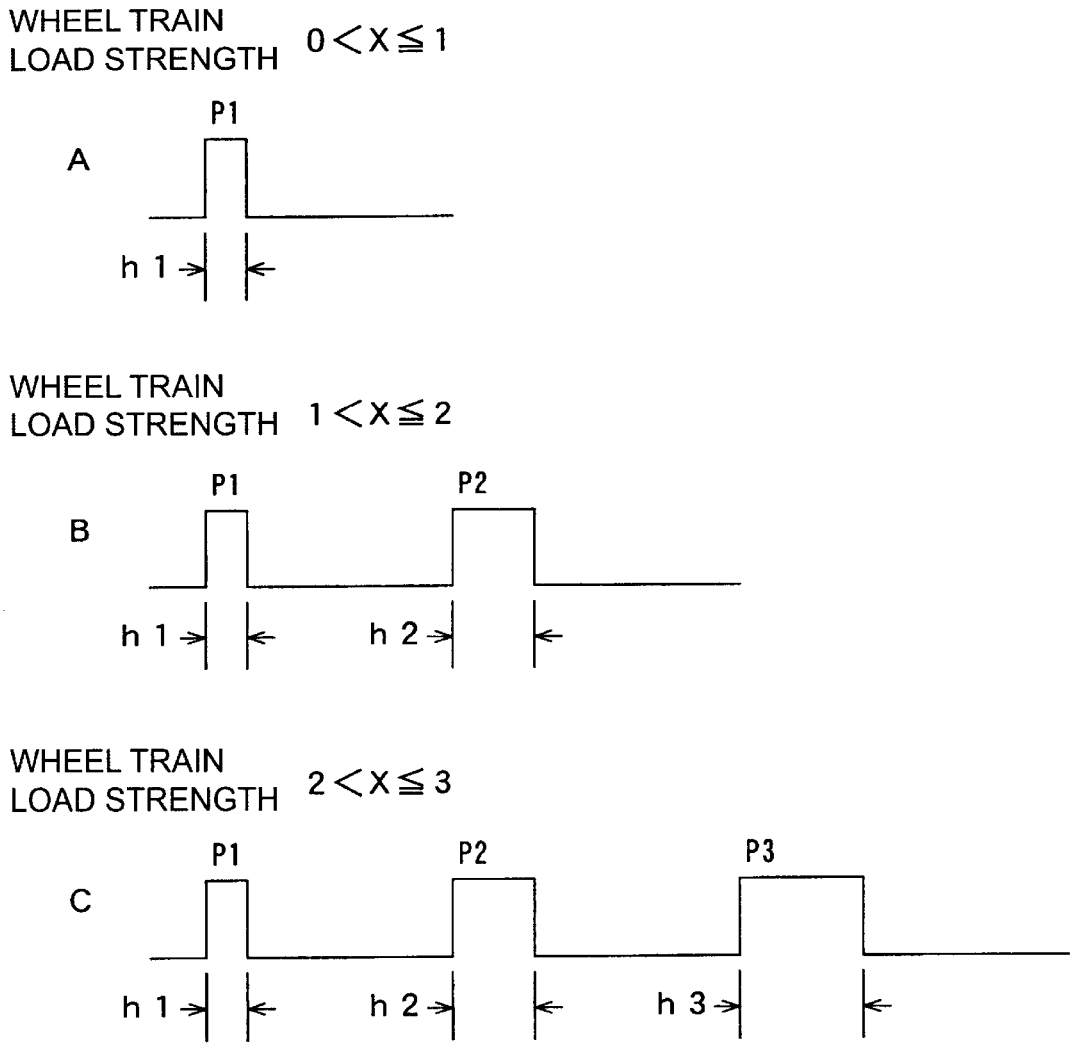
FIG. 2 is a chart explaining a normal driving pulse, a first auxiliary driving pulse and a second auxiliary driving pulse.

As shown in FIG. 2, a pulse width h3 of the second auxiliary driving pulse P3 is wider than a pulse width h2 of the first auxiliary driving pulse P2. The pulse width h2 of the first auxiliary driving pulse P2 is also wider than a pulse width h1 of the normal driving pulse P1. It is noted that when the load strength X applied to the wheel train is $0<X\leqq 1$ as shown in FIG. 2*a,* the motor 6 rotates by the normal driving pulse P1 or the first auxiliary driving pulse P2 or second auxiliary driving pulse P3 whose strength is greater than the normal driving pulse P1. When the load strength X applied to the wheel train is $1<X\leqq 2$ as shown in FIG. 2*b,* the motor 6 rotates by the first auxiliary driving pulse P2 or the timer circuit 3 whose strength is greater than the first auxiliary driving pulse P2. When the load strength X applied to the wheel train is $2<X\leqq 3$, i.e., the minute hand stands at twelve o'clock as shown in FIG. 2*c,* the motor 6 rotates only by the second auxiliary driving pulse.

It is noted that when the normal driving pulse P1, the first auxiliary driving pulse P2 and the second auxiliary driving pulse P3 are outputted continuously as shown in FIG. 2*c,* the time from the leading edge of the normal driving pulse P1 to the trailing edge of the second auxiliary driving pulse P3 is one second or less. It is noted that the generation of the normal driving pulse P1 and the first auxiliary driving pulse P2 and the effects of these driving pulses are described in Japanese Patent Publication Nos. 63-18148, 63-18149 and 57-18440 in detail for example, so that their explanation will be omitted here. The second auxiliary driving pulse P3 may be also generated in the same manner with the normal driving pulse P1 and the first auxiliary driving pulse P2, so that its detailed explanation will be omitted here.

Figure 3:
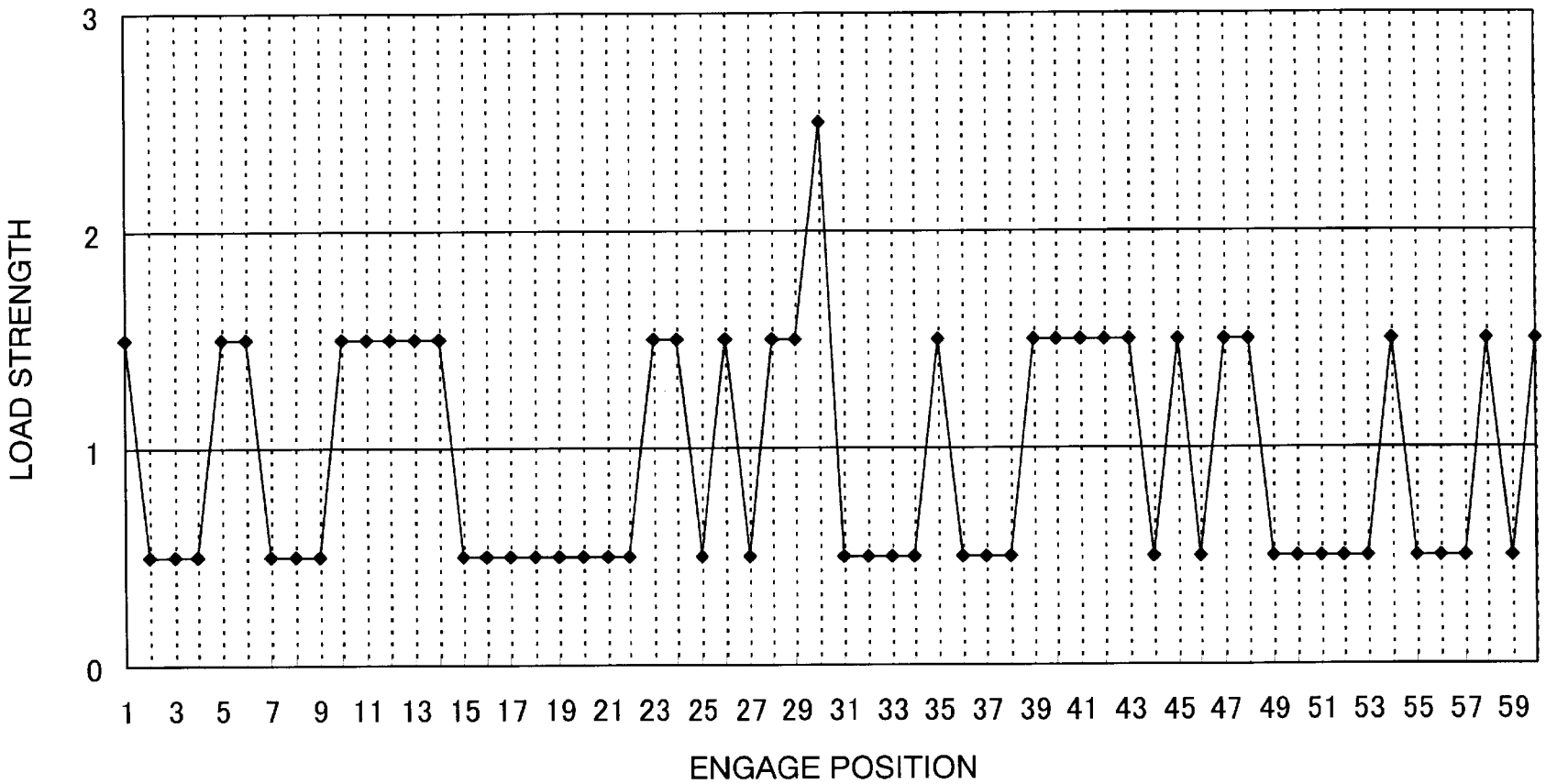
FIG. 3 is a graph showing fluctuation of load strength.

FIG. 3 is a graph showing fluctuation of the load strength of the wheel train 7. Although the load strength of the wheel train 7 fluctuates at intervals of one second because the motor 6 normally rotates at intervals of one second, the fluctuation of the load strength of the wheel train 7 will be shown at intervals of one second in FIG. 3 for the convenience of the explanation. In FIG. 3, the vertical axis represents the load strength of the wheel train 7 and the horizontal axis represents engage position. It is noted that the motor 6 rotates by the normal driving pulse P1 at the engage position where the load strength is $0<X\leqq 1$ (the engage positions 2 through 4 for example).

Meanwhile, the motor 6 does not rotate by the normal driving pulse P1 but rotates by the first auxiliary driving pulse P2 or the second auxiliary driving pulse P3 at the engage position where the load strength is $1<X\leqq 2$ (the engage positions 5 and 6 for example). The motor 6 does not rotate by the normal driving pulse P1 or the first auxiliary driving pulse P2 but rotates only by the second auxiliary driving pulse P3 at the engage position where the load strength is $2<X\leqq$ 3 (the engage position 30 for example). It is noted that the timer circuit 30 where the load strength is $2<X\leqq 3$ corresponds to the position where high load is applied to the wheel train 7 by the structure of the center wheel & pinion, i.e., the position where the minute hand stands at twelve o'clock.

The rotation judging circuit 9 judges whether or not the motor 6 rotates when the normal driving pulse P1, the first auxiliary driving pulse P2 or the second auxiliary driving pulse P3 is outputted from the pulse control circuit 4 based on induced voltage generated in the motor 6. Then, it inputs a P1 non-rotation signal indicative of that the motor 6 does not rotate by the normal driving pulse P1 to the pulse control circuit 4 when the motor 6 does not rotate when the normal driving pulse P1 is outputted from the pulse control circuit 4. It also inputs a P2 non-rotation signal indicative of that the motor 6 does not rotate by the first auxiliary driving pulse P2 to the pulse control circuit 4 when the motor 6 does not rotate when the first auxiliary driving pulse P2 is outputted from the pulse control circuit 4.

Normally, the pulse control circuit 4 outputs the normal driving pulse P1 which consumes less power and the motor 6 rotates by the normal driving pulse P1. The motor 6 does not rotate by the normal driving pulse P1 when the load strength of the motor 6 exceeds one by some reason. Then, the rotation judging circuit 9 inputs the P1 non-rotation signal to the pulse control circuit 4. When the pulse control circuit 4 receives the P1 non-rotation signal from the rotation judging circuit 9, the motor driving circuit 5 outputs the first auxiliary driving pulse P2.

It is noted that because high strength is applied to the motor 6 at the timer circuit 30 shown in FIG. 3, i.e., when the minute hand stands at twelve o'clock, the load strength exceeds 2. Thereby, the motor 6 does not rotate by the first auxiliary driving pulse P2 and the rotation judging circuit 9 inputs the P2 non-rotation signal to the pulse control circuit 4. Receiving the P2 non-rotation signal from the rotation judging circuit 9, the pulse control circuit 4 outputs the second auxiliary driving pulse P3 to the motor driving circuit 5 to always rotate the motor 6 and inputs a P3 output signal to the pointer position detecting circuit 10.

When the minute hand stands at twelve o'clock, the second auxiliary driving pulse P3 is outputted from the pulse control circuit 4 as described above. In other words, when the second auxiliary driving pulse P3 is outputted from the pulse control circuit 4, the minute hand stands at twelve o'clock. It is noted that when the second auxiliary driving pulse P3 is outputted, the pulse control circuit 4 outputs the P3 output signal to the pointer position detecting circuit 10. Receiving the P3 output signal, the pointer position detecting circuit 10 assumes that the minute hand stands at twelve o'clock and outputs a time sounding signal to a circuit for sounding the time for example (not shown). Thereby, the time is sounded when the minute hand stands at twelve o'clock.

Figure 4:
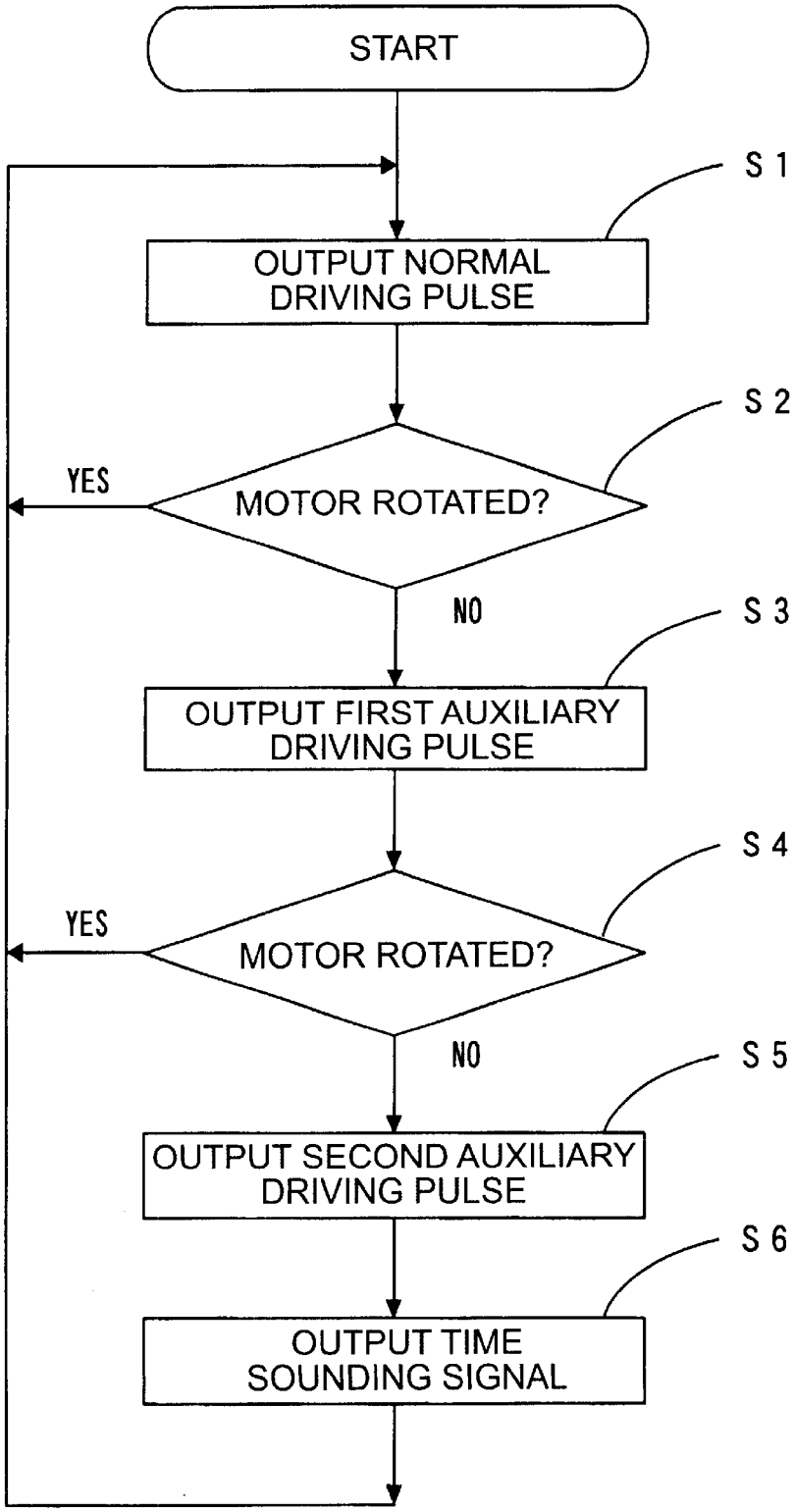
FIG. 4 is a flowchart showing operations of the electronic clock in FIG. 1.

FIG. 4 is a flowchart showing operations of the electronic clock 100. In Step S1, the pulse control circuit 4 outputs the normal driving pulse P1. In Step S2, the rotation judging circuit 9 judges whether or not the motor 6 rotates and inputs the P1 non-rotation signal to the pulse control circuit 4 when the motor 6 does not rotate. When the P1 non-rotation signal is not outputted from the rotation judging circuit 9 within a predetermined time, i.e., when the motor 6 rotates by the normal driving pulse P1, the pulse control circuit 4 outputs the next P1 by returning to Step S1.

When the pulse control circuit 4 receives the P1 non-rotation signal from the rotation judging circuit 9, i.e., when the motor 6 does not rotate by the normal driving pulse P1, it outputs the first auxiliary driving pulse P2 in Step S3. In Step S4, the rotation judging circuit 9 judges whether or not the motor 6 rotates and inputs the P2 non-rotation signal to the pulse control circuit 4 when the motor 6 does not rotate. When the P2 non-rotation signal is not outputted from the rotation judging circuit 9 within a predetermined time, i.e., when the motor 6 rotates by the first auxiliary driving pulse P2, the pulse control circuit 4 outputs the next p1 by returning to Step S1.

When the pulse control circuit 4 receives the P2 non-rotation signal from the rotation judging circuit 9, i.e., when the motor 6 does not rotate by the first auxiliary driving pulse P2, it outputs the second auxiliary driving pulse P3 and inputs the P3 output signal to the pointer position detecting circuit 10 in Step S5. In Step S6, the pointer position detecting circuit 10 outputs the time sounding signal to the circuit for sounding the time.

The electronic clock 100 is arranged so as to apply the high load to the wheel train 7 at predetermined pointer position, to rotate the motor 6 normally by the normal driving pulse P1 or the first auxiliary driving pulse P2 and to rotate the motor 6 by the second auxiliary driving pulse P3 only when the high load is applied to the wheel train 7 as described above. Therefore, because the pointer comes to the predetermined position when the second auxiliary driving pulse P3 is outputted, the pointer position may be detected by utilizing the least minimum structure for operating the electronic clock and no individual structure nor electrical device for detecting the pointer position is required. Thereby, it becomes possible to compact the clock, to reduce the cost and to reduce the power consumption.

It is noted that although the present invention has been explained above by applying the invention to the case of sounding the time by detecting that the minute hand stands at twelve o'clock, the invention is not limited to such case and may be applied to a case of turning a calendar at twelve o'clock in midnight or of adjusting time based on radio wave received from the outside.

[Second Embodiment]

Figure 5:
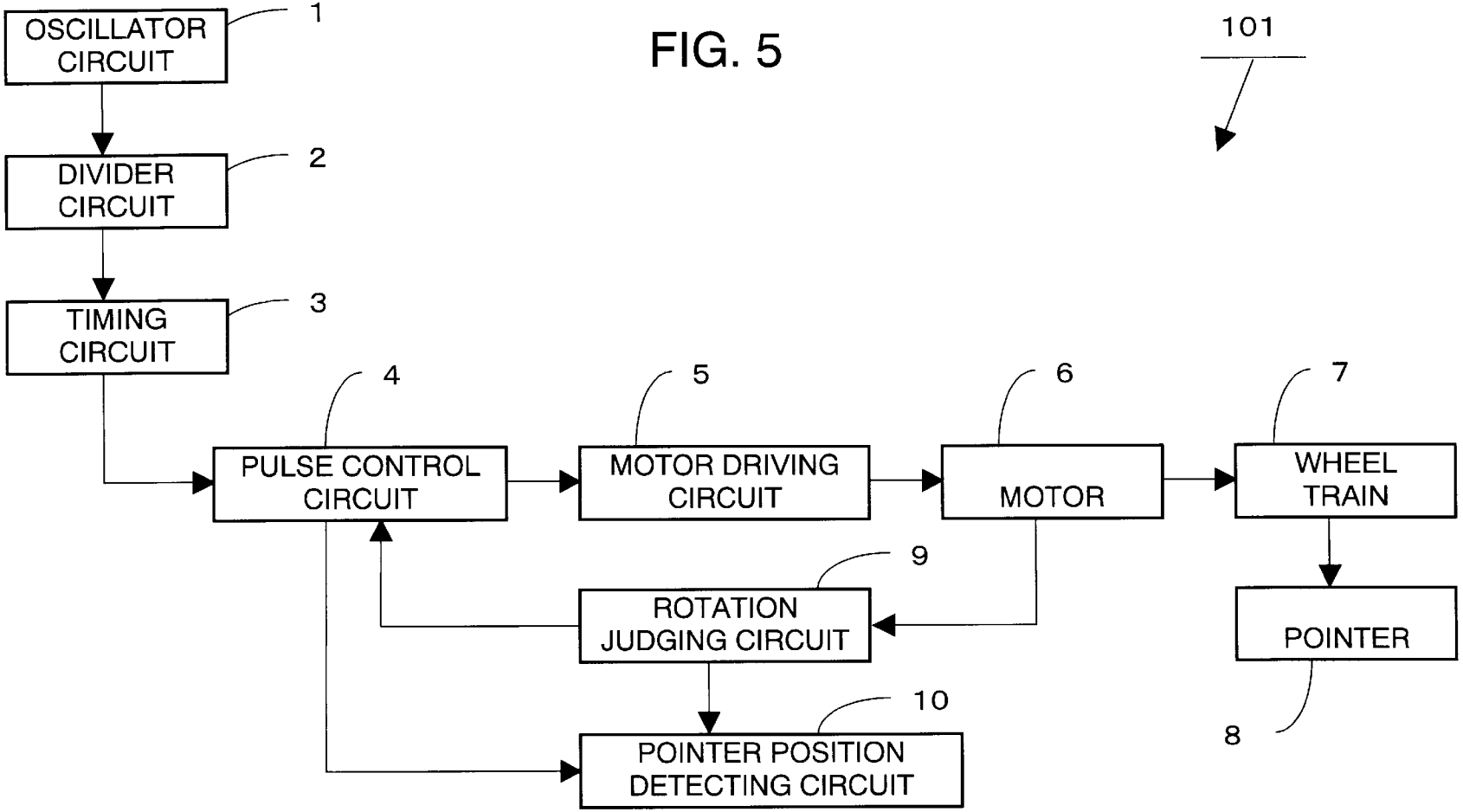
FIG. 5 is a block diagram of an electronic clock according to a second embodiment of the invention.

FIG. 5 is a block diagram of an electronic clock according to a second embodiment of the invention. This electronic clock 101 is what the electronic clock 100 in the first embodiment is modified so as to input the P2 non-rotation signal from the rotation judging circuit 9 to the pointer position detecting circuit 10. It is noted that the structure thereof other than that is the same with the electronic clock 100 in the first embodiment, so that an explanation thereof will be omitted here. It is also noted that the center wheel & pinion is formed so that the high load X ($2<X\leqq 3$) is applied to the wheel train 7 when the minute hand stands at twelve o'clock similarly to the electronic clock 100 in the first embodiment.

The rotation judging circuit 9 judges whether or not the motor 6 rotates when the normal driving pulse P1, the first auxiliary driving pulse P2 or the second auxiliary driving pulse P3 is outputted from the pulse control circuit 4. Then, it inputs the P1 non-rotation signal to the pulse control circuit 4 when the motor 6 does not rotate when the normal driving pulse P1 is outputted from the pulse control circuit 4. It also inputs the P2 non-rotation signal to the pulse control circuit 4 the pointer position detecting circuit 10 when the motor 6 does not rotate when the first auxiliary driving pulse P2 is outputted from the pulse control circuit 4.

Because high strength is applied to the motor 6 at the timer circuit 30 shown in FIG. 3, i.e., when the minute hand stands at twelve o'clock, the load strength exceeds 2. Thereby, the motor 6 does not rotate by the first auxiliary driving pulse P2 and the rotation judging circuit 9 inputs the P2 non-rotation signal to the pulse control circuit 4 and the pointer position detecting circuit 10. Receiving the P2 non-rotation signal from the rotation judging circuit 9, the pulse control circuit 4 outputs the second auxiliary driving pulse P3 to the motor driving circuit 5 to always rotate the motor 6 and inputs the P3 output signal to the pointer position detecting circuit 10.

When the minute hand stands at twelve o'clock, the pointer position detecting circuit 10 receives the P2 non-rotation signal from the rotation judging circuit 9 and the P3 output signal from the pulse control circuit 4 as described above. Thus, the pointer position detecting circuit 10 detects that the minute hand stands at twelve o'clock in double by the P2 non-rotation signal and the P3 output signal. Receiving the P2 non-rotation signal and the P3 output signal, the pointer position detecting circuit 10 assumes that the minute hand stands at twelve o'clock and outputs a time sounding signal to the circuit for sounding the time for example (not shown). Thereby, the time is sounded when the minute hand stands at twelve o'clock.

It is noted that although the electronic clock of the second embodiment has been explained so as to input the P3 output signal from the pulse control circuit 4 to the pointer position detecting circuit 10, the P3 output signal may not be inputted from the pulse control circuit 4 to the pointer position detecting circuit 10 because the pointer position detecting circuit 10 can detect the position of the minute hand by the P2 non-rotation signal from the rotation judging circuit 9. Thereby, the circuit for outputting the P3 output signal of the pulse control circuit 4 may be eliminated. when the pointer comes to the predetermined position, the pointer position detecting circuit 10 receives the P2 non-rotation signal from the rotation judging circuit 9 and the P3 output signal from the pulse control circuit 4 in the electronic clock 101 as described above. Therefore, because it becomes possible to detect the pointer position in double, the precision of detection may be enhanced.

[Third Embodiment]

Figure 6:
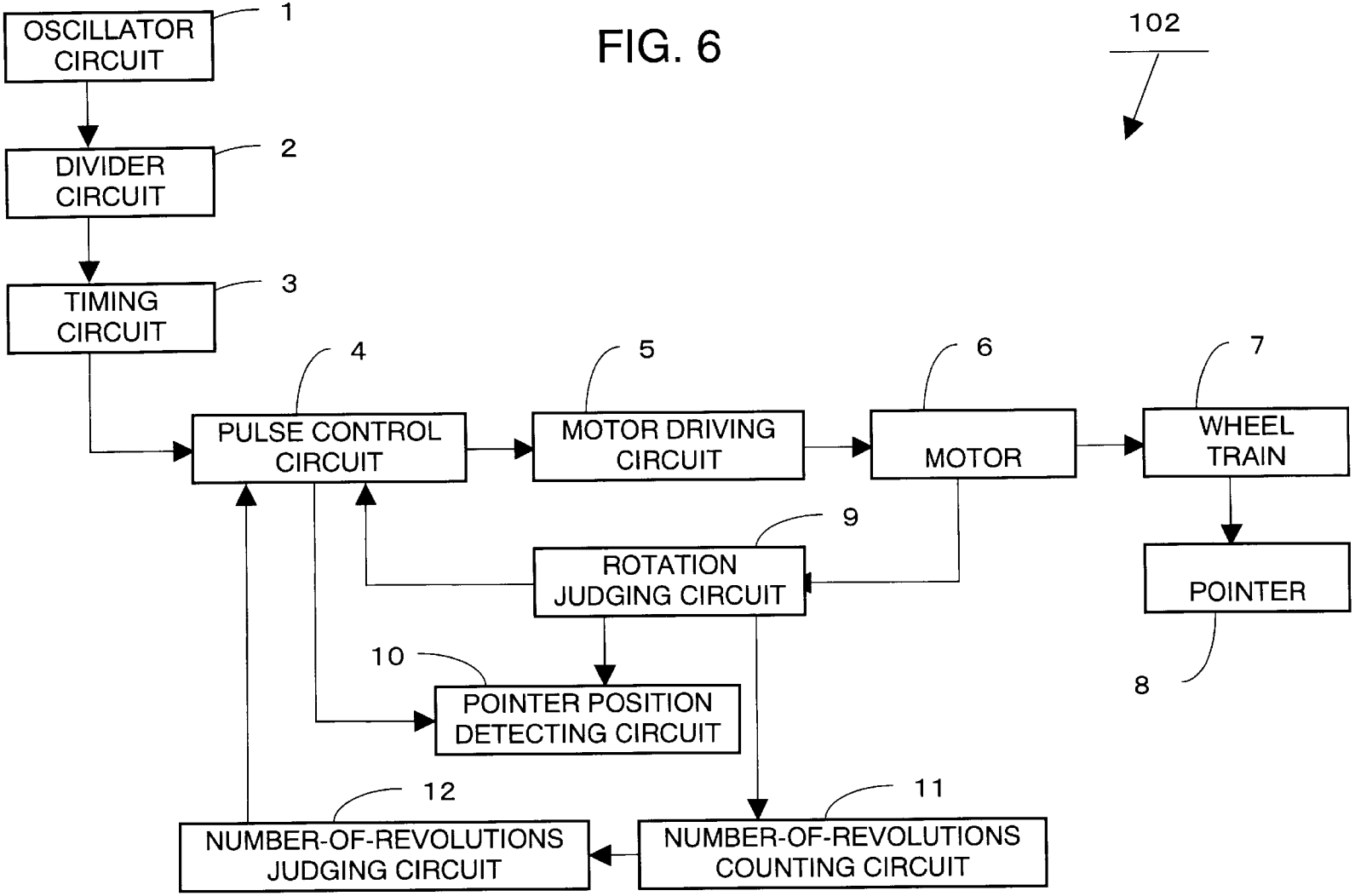
FIG. 6 is a block diagram of an electronic clock according to a third embodiment of the invention.

FIG. 6 is a block diagram of an electronic clock according to a third embodiment of the invention. This electronic clock 102 is constructed by adding a number-of-revolutions counting circuit 11 and a number-of-revolutions judging circuit 12 to the electronic clock 101 of the second embodiment. It is noted that the center wheel & pinion of the wheel train 7 is formed so that the high load X ($2<X\leqq 3$) is applied to the wheel train 7 when the minute hand stands at twelve o'clock similarly to the electronic clock 101 in the second embodiment.

The rotation judging circuit 9 judges whether or not the motor 6 rotates when the normal driving pulse P1, the first auxiliary driving pulse P2 or the second auxiliary driving pulse P3 is outputted from the pulse control circuit 4. Then, it inputs the P1 non-rotation signal to the pulse control circuit 4 when the motor 6 does not rotate when the normal driving pulse P1 is outputted from the pulse control circuit 4. It also inputs the P2 non-rotation signal to the pulse control circuit 4 and the pointer position detecting circuit 10 when the motor 6 does not rotate when the first auxiliary driving pulse P2 is outputted from the pulse control circuit 4. It also inputs a reset signal for resetting a number of revolution of the motor 6 to the number-of-revolutions counting circuit 11.

When the motor 6 rotates when the normal driving pulse P1 is outputted from the pulse control circuit 4, the rotation judging circuit 9 also inputs a P1 rotation signal indicative of that the motor 6 rotates by the normal driving pulse P1 to the number-of-revolutions counting circuit 11. When the motor 6 rotates when the first auxiliary driving pulse P2 is outputted from the pulse control circuit 4, the rotation judging circuit 9 inputs a P2 rotation signal indicative of that the motor 6 rotates by the first auxiliary driving pulse P2 to the number-of-revolutions counting circuit 11.

The number-of-revolutions counting circuit 11 counts the P1 and P2 rotation signals received from the rotation judging circuit 9, i.e., counts the number of revolution of the motor 6, and inputs a number-of-revolution signal to the number-of-revolutions judging circuit 12 based on that count. A number of revolutions of the motor 6 corresponding to the period where the high load is applied to the wheel train is set in the number-of-revolutions judging circuit 12 in advance. When the number of revolutions which is based on the number-of-revolutions signal received from the number-of-revolutions counting circuit 11 reaches to the preset number of revolutions, the number-of-revolutions judging circuit 12 inputs a P3 output control signal to the pulse control circuit 4. Receiving the P3 output control signal from the number-of-revolutions judging circuit 12, the pulse control circuit 4 outputs the second auxiliary driving pulse P3 directly to the motor driving circuit 5 without outputting the normal driving pulse P1 nor P2.

Figure 7:
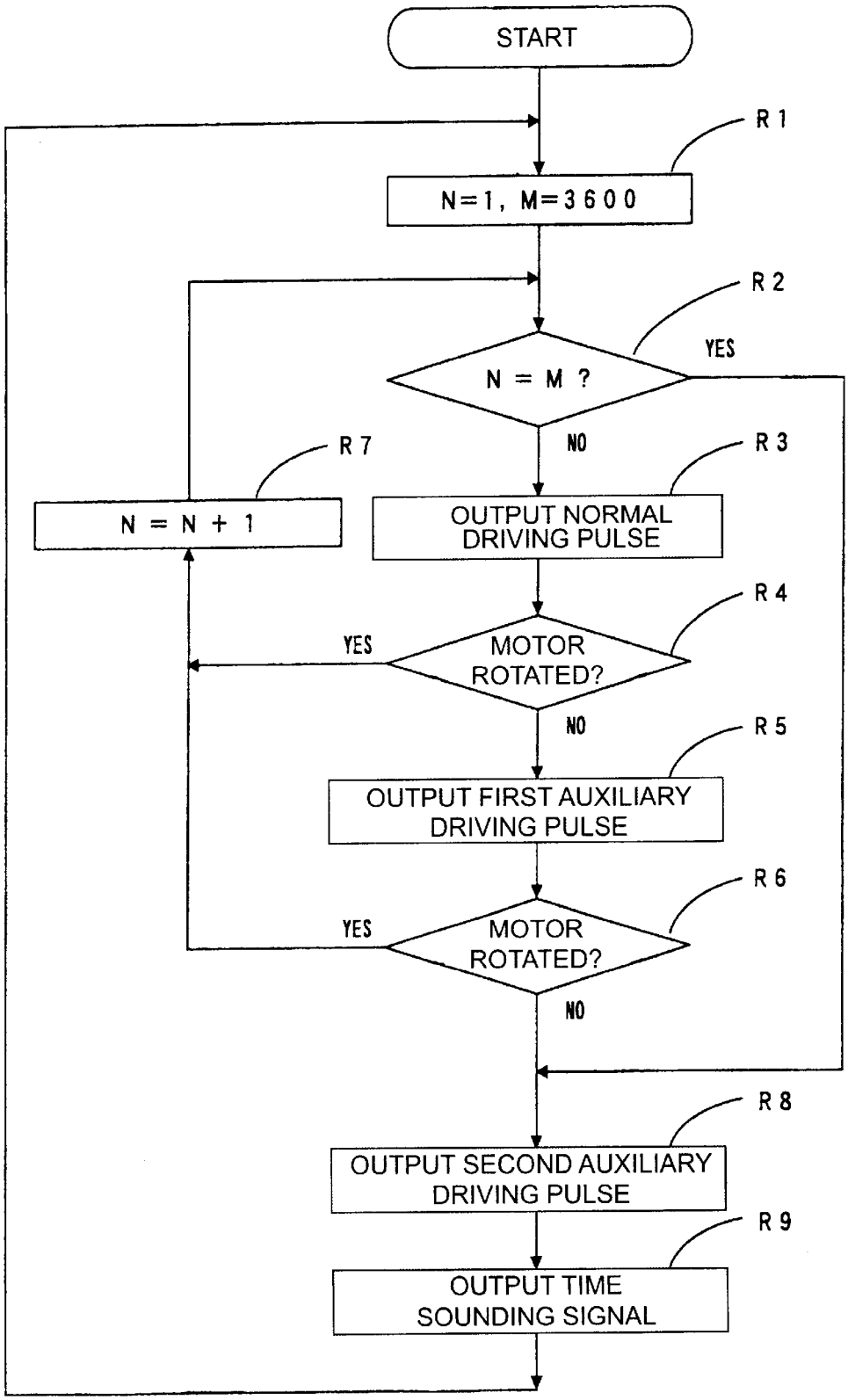
FIG. 7 is a flowchart showing operations of the electronic clock in FIG. 6.
Figure 8:
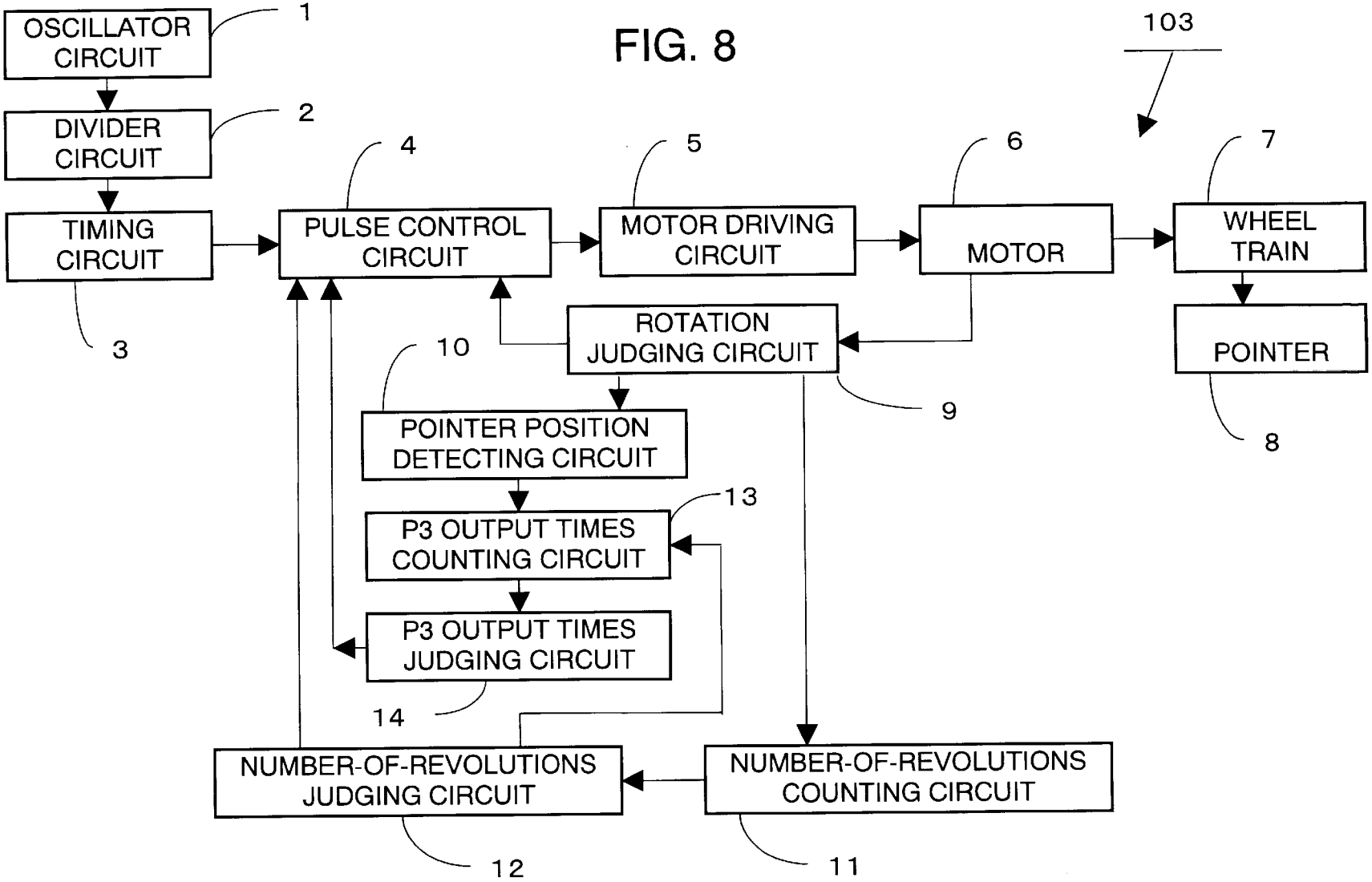
FIG. 8 is a block diagram of an electronic clock according to a fourth embodiment of the invention.

FIG. 7 is a flowchart showing operations of the electronic clock 102. In Step R1, the number-of-revolutions counting circuit 11 initializes the number of revolutions N as N=1 and sets the maximum number of revolutions M to the number-of-revolutions judging-circuit 12. It is noted that the motor 6 rotates 3600 times in an hour as it rotates once per second. Thereby, the minute hand indicative of twelve o'clock stands twelve o'clock again after when the motor 6 rotates 3600 times. Accordingly, the cycle of applying the high load to the wheel train is "once per an hour" when the time is sounded when the minute hand stands at twelve o'clock and the maximum number of revolutions M of the motor 6 corresponding to that cycle is 3600. Accordingly, 3600 is set in the number-of-revolutions judging circuit 12 in advance as the maximum number of revolutions M.

In Step R2, the number-of-revolutions judging circuit 12 judges whether or not N=M based on the number-of-revolutions signal sent from the number-of-revolutions counting circuit 11. When N=M, the operation advances to Step R8 and N≠M, the operation advances to Step R3. In Step R3, the pulse control circuit 4 outputs the normal driving pulse P1. in Step R4, the rotation judging circuit 9 judges whether or not the motor 6 rotates. When the motor 6 rotates, the rotation judging circuit 9 outputs the P1 rotation signal to the number-of-revolutions counting circuit 11 and when the motor 6 does not rotate, the rotation judging circuit 9 outputs the P1 non-rotation signal to the pulse control circuit 4. Because the number-of-revolutions counting circuit 11 receives the P1 rotation signal from the rotation judging circuit 9, it increments the value of the number of revolutions N by one in step R7.

The pulse control circuit 4 outputs the first auxiliary driving pulse P2 in Step R5 when the P1 non-rotation signal is outputted from the rotation judging circuit 9, i.e., when the motor 6 was not rotated by the normal driving pulse P1. In Step R6, the rotation judging circuit 9 judges whether or not the motor 6 rotates. It outputs the P2 rotation signal to the number-of-revolutions counting circuit 11 when the motor 6 was rotated and outputs the P2 non-rotation signal to the pulse control circuit 4 when the motor 6 was not rotated. In Step R7, the number-of-revolutions counting circuit 11 increments the value of the number of revolutions N by one because it has received the P2 rotation signal from the rotation judging circuit 9.

When the rotation judging circuit 9 outputs the P2 non-rotation signal, i.e., when the motor 6 was not rotated by the first auxiliary driving pulse P2, the pulse control circuit 4 outputs the second auxiliary driving pulse P3 and inputs the P3 output signal to the pointer position detecting circuit 10 in Step R8. In Step R9, the pointer position detecting circuit 10 outputs a time sounding signal to the circuit for sounding the time. Then, the operations of Steps R1 through R9 are repeatedly executed unless a battery runs out.

These operations will be explained by using FIG. 3. When the engage position comes to the timer circuit 30 for the first time since the start of the operation of the clock, the rotation judging circuit 9 inputs the reset signal to the number-of-revolutions counting circuit 11 because the motor 6 does not rotate by the first auxiliary driving pulse P2 even though the number of revolutions N does not reach the maximum number of revolutions M. Thereby, the number-of-revolutions counting circuit 11 initializes the number of revolutions N to 1.

When the number of revolutions N reaches to the maximum number of revolutions M after that (Yes in Step R2), the motor 6 rotates by 3600 times and comes to the timer circuit 30 and the motor 6 rotates only by second auxiliary driving pulse P3. Then, when the number of revolutions N reaches to the maximum number of revolutions M, a P3 output control signal is inputted from the number-of-revolutions judging circuit 12 to the pulse control circuit 4 to output the second auxiliary driving pulse P3 from the pulse control circuit 4.

Because the high load is applied to the wheel train and the motor 6 rotates only by the second auxiliary driving pulse P3 when the number of revolutions N reaches to the maximum number of revolutions M in the electronic clock 102 as described above, the pulse control circuit 4 outputs the second auxiliary driving pulse P3. Therefore, it becomes possible to save power consumed to output the normal driving pulse P1 and the first auxiliary driving pulse P2.

[Fourth Embodiment]

FIG. a is a block diagram of an electronic clock according to a fourth embodiment of the invention. This electronic clock 103 is constructed by adding a P3 output times counting circuit 13 and a P3 output number-of-times judging circuit 14 to the electronic clock 102 of the third embodiment. It is noted that the center wheel & pinion of the wheel train 7 is formed so that the high load X ($2<X\leqq3$) is applied to the wheel train 7 when the minuteh and stands at twelve o'clock similarly to the electronic clock 101 of the second embodiment.

The rotation judging circuit 9 judges whether or not the motor 6 rotates when the normal driving pulse P1, the first auxiliary driving pulse P2 or the second auxiliary driving pulse P3 is outputted from the pulse control circuit 4. Then, it inputs the P1 non-rotation signal to the pulse control circuit 4 when the motor 6 does not rotate when the normal driving pulse P1 is outputted from the pulse control circuit 4. It also inputs the P2 non-rotation signal to the pulse control circuit 4 and the pointer position detecting circuit 10 when the motor 6 does not rotate when the first auxiliary driving pulse P2 is outputted from the pulse control circuit 4. It also inputs a reset signal A for resetting a number of revolutions of the motor 6 to the number-of-revolutions counting circuit 11.

The pointer position detecting circuit 10 inputs the P3 output signal to the P3 output times counting circuit 13. The P3 output times counting circuit 13 counts a number of times of the P3 output signal received from the pointer position detecting circuit 10, i.e., a number of times of the second auxiliary driving pulse P3 outputted from the pulse control circuit 4, and inputs the P3 output number-of-times signal to the P3 output times judging means 14 based on that count.

The number-of-revolutions counting circuit 11 counts the P1 rotation signals and the F2 rotation signals received from the rotation judging circuit 9, i.e., a number of revolutions of the motor 6, and inputs a rotation number-of-times signal to the number-of-revolutions judging circuit 12 based on that count. A number of revolutions of the motor corresponding to the cycle in which the high load is applied to the wheel train is set in the number-of-revolutions judging circuit 12 in advance. When the number of revolutions based on the number of revolutions signal received from the number-of-revolutions counting circuit 11 reaches to the number of revolutions set in advance, the number-of-revolutions judging circuit 12 inputs the P3 output control signal to the pulse control circuit 4 and inputs a reset signal B for resetting the P3 output times counted by the P3 output times counting circuit 13 to the P3 output times counting circuit 13.

An output times of the second auxiliary driving pulse P3 corresponding to the cycle in which the high load is applied to the wheel train is set in the P3 output times judging means 14 in advance. When the output times which is based on the P3 output times signal received from the P3 output times counting circuit 13 exceeds the output times, the P3 output times judging means 14 inputs a pulse output stopping signal to the pulse control circuit 4. Receiving the pulse output stopping signal from the P3 output times counting circuit 13, the pulse control circuit 4 stops the output of the driving pulses such as the normal driving pulse P1, first auxiliary driving pulse P2 and second auxiliary driving pulse P3. Thereby, the operation of the clock ends.

The motor 6 rotates by 3600 times in an hour as it rotates once in a second. Because the high load is applied to the wheel train when the minute hand stands at twelve o'clock, the second auxiliary driving pulse P3 is required once during when the motor 6 rotates by 3600 times. Then, when 1 is set as the output times in the P3 output times judging means 14 and when the second auxiliary driving pulse P3 is outputted twice from the pulse control circuit 4 during when the motor 6 rotates by 3600 times, it means that unpredictable high load is applied to the motor 6, i.e., the clock is defective. When the defect of the clock is thus detected, the pulse output stopping signal is inputted from the P3 output times judging means 14 to the pulse control circuit 4 to stop the clock.

As described above, it is judged whether or not the clock is operating normally based on the. output times of the second auxiliary driving pulse P3 and the operation of the clock is stopped when the defect of the clock is detected in the electronic clock 103. Thereby, it becomes possible to prevent power from being consumed uselessly and to inform of the defect of the clock to its owner.

It is noted that although the above-mentioned embodiment has been explained so as to stop the operation of the clock when the defect of the clock is detected, it is also possible to modify it so as to change the interval of the driving pulses outputted from the pulse control circuit 4. For instance, while the driving pulse is outputted once normally in a second, it becomes possible to prevent power from being consumed uselessly and to inform of the defect of the clock to its owner by arranging so as to output the driving pulses by five times at intervals of 5 seconds when the defect of the clock is detected.

[Fifth Embodiment]

Figure 9:
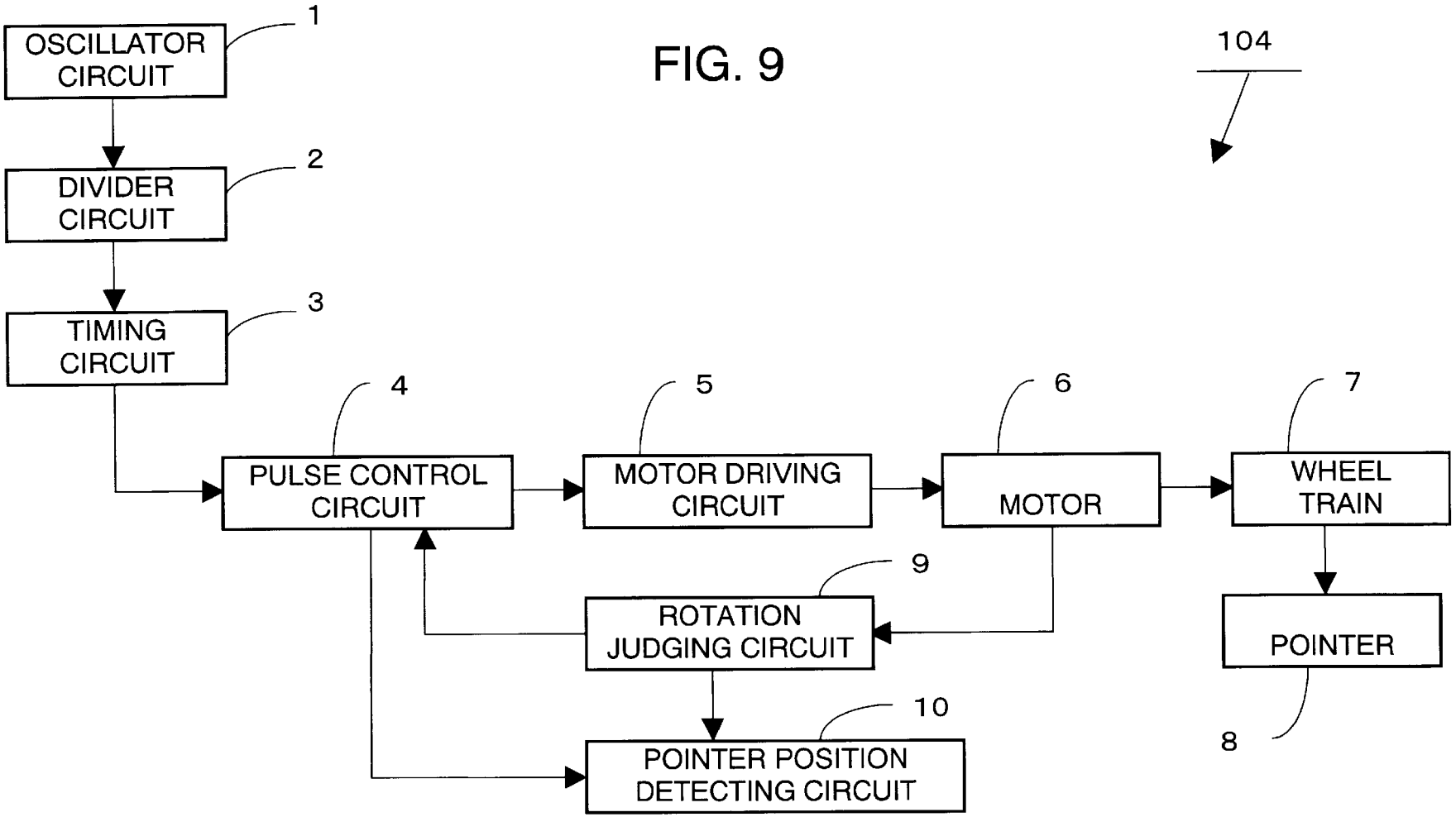
FIG. 9 is a block diagram of an electronic clock according to a fifth embodiment of the invention.

FIG. 9 is a block diagram of an electronic clock according to a fifth embodiment of the invention. This electronic clock 104 is arranged so as to input the P1 rotation signal and the P2 rotation signal from the rotation judging circuit 9 to the pointer position detecting circuit 10 in the electronic clock 100 of the first embodiment. The center wheel & pinion of the wheel train 7 is formed so that the high load X ($2<X\leqq3$) is applied to the wheel train 7 continuously by five times from five seconds before the minute hand stands at twelve o'clock. Other than that, the structure of the electronic clock 104 is the same with the electronic clock 100 of the first embodiment, so that an explanation thereof will be omitted here.

Figure 10:
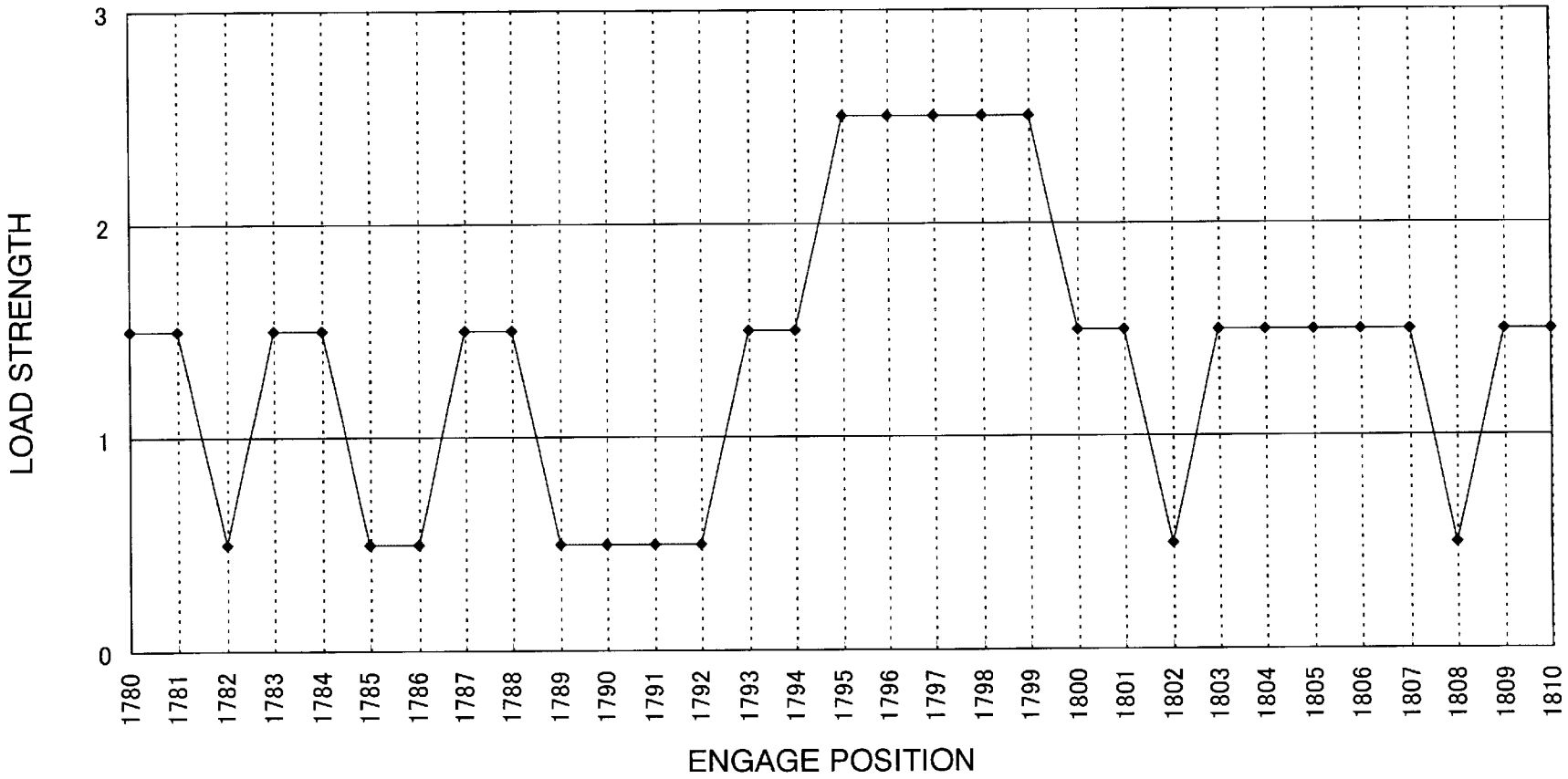
FIG. 10 is a graph showing fluctuation of load strength.

FIG. 10 is a graph showing fluctuation of load strength of the wheel train 7 at intervals of one second. In FIG. 10, the vertical axis represents the load strength of the wheel train 7 and the horizontal axis represents the engage position. It is noted that the motor 6 rotates by the normal driving pulse P1 at the engage position, e.g., the engage positions 1791 and 1792, where the load strength is $0<X\leqq1$.

Meanwhile, the motor 6 does not rotate by the normal driving pulse P1 and rotates by the first auxiliary driving pulse P2 or the second auxiliary driving pulse P3 at the engage position, e. g., the engage positions 1793, 1794, where the load strength is $1<X\leqq2$. The motor 6 does not rotate by the normal driving pulse P1 or the first auxiliary driving pulse P2 and rotates only by the second auxiliary driving pulse P3 at the engage position, e.g., the engage positions 1795 to 1799, where the load strength is $2<X\leqq 3$. It is noted that the engage positions 1795 through 1799 where the load strength is $2<X\leqq 3$ correspond to the positions where the load strength is applied to the wheel train 7 continuously by five times and the engage position 1800 corresponds to the position where the minute hand stands at twelve o'clock by the structure of the center wheel & pinion.

When the motor 6 rotates when the normal driving pulse P1 is outputted from the pulse control circuit 4, the rotation judging circuit 9 inputs the P1 rotation signal to the pointer position detecting circuit 10. When the motor 6 rotates when the first auxiliary driving pulse P2 is outputted from the pulse control circuit 4, the rotation judging, circuit 9 inputs the P2 rotation signal to the pointer position detecting circuit 10. The pulse control circuit 4 also inputs the P3 output signal to the pointer position detecting circuit 10 when the second auxiliary driving pulse P3 is outputted. Thereby, the second auxiliary driving pulse P3 is outputted from the pulse control circuit 4 to the pointer position detecting circuit 10 continuously by five times and it becomes possible to judge whether or not the motor 6 rotates by the normal driving pulse P1 or the first auxiliary driving pulse P2.

The pointer position detecting circuit 10 counts an output times of the second auxiliary driving pulse P3 based on the P3 output signal inputted from the pulse control circuit 4 and outputs a time sounding signal to the circuit (not shown) for sounding time for example by assuming that the minute hand stands at twelve o'clock when it counts five times and it then receives the P1 rotation signal or the P2 rotation signal from the rotation judging circuit 9. Thereby, the time is sounded when the minute hand stands at twelve o'clock.

The pointer comes to the predetermined position when the second auxiliary driving pulse P3 is outputted continuously by a plurality of times and then the motor 6 rotates by the normal driving pulse P1 and the first auxiliary driving pulse P2 in the electronic clock 104, so that it becomes possible to detect the position of the pointer by utilizing the minimum required structure for operating the electronic clock and to compact the clock, to lower the cost and to reduce the power consumption because the individual structure and electrical device for detecting the pointer position are unnecessary.

As described above, according to the inventive electronic clock and pointer position detecting method, the high load is applied to the wheel train when indicator means comes to the predetermined position and pulse control means outputs the second auxiliary driving pulse when the high load is applied. Therefore, it means that the indicator means has come to the predetermined position when the second auxiliary driving pulse is outputted from the pulse control means. It then becomes possible to detect the pointer position by utilizing the minimum required structure for operating the electronic clock and to compact the clock, to lower the cost and to reduce the power consumption because the individual structure and electrical device for detecting the pointer position are unnecessary.

According to the inventive electronic clock and pointer position detecting method, it is judged that the pointer has come to the predetermined position when the non-rotation signal is outputted from rotating judging means after outputting a first auxiliary driving pulse. It is noted that when the motor does not rotate after when the first auxiliary driving pulse is outputted, it means the high load is applied to the wheel train, i.e., the indicator means has come to the predetermined position. It then becomes possible to detect the pointer position by utilizing the minimum required structure for operating the electronic clock and to compact the clock, to lower the cost and to reduce the power consumption because the individual structure and electrical device for detecting the pointer position are unnecessary.

According to the inventive electronic clock and pointer position detecting method, the second auxiliary driving pulse is outputted at the position where the high load is applied to the wheel train without outputting the normal driving pulse or the first auxiliary driving pulse. Thereby, it becomes possible to prevent power for outputting the normal driving pulse or the first auxiliary driving pulse from being consumed uselessly.

According to the inventive electronic clock and pointer position detecting method, the operation of the clock is stopped by assuming that the clock is defective when the second auxiliary driving pulse is outputted more than a number of times known in advance. Thereby, it becomes possible to prevent power for outputting the driving pulses from being consumed uselessly and to inform of the defect of the clock to its user.

According to the inventive electronic clock and pointer position detecting method, output intervals of the driving pulses is changed by assuming that the clock is defective when the second auxiliary driving pulse is outputted more than a number of times known in advance. Thereby, it becomes possible to inform of the defect of the clock to the user.

According to the inventive electronic clock and pointer position detecting method, high load is applied to the wheel train continuously by a plurality of times before the indicator means comes to the predetermined position and the pulse control means outputs the second auxiliary driving pulses continuously by a plurality of times when the high load is applied. Therefore, when the second auxiliary driving pulse is outputted from the pulse control means and then the motor rotates by the normal driving pulse or the second auxiliary driving pulse, it means that the indicator means has come to the predetermined position. It then becomes possible to detect the pointer position by utilizing the minimum required structure for operating the electronic clock and to compact the clock, to lower the cost and to reduce the power consumption because the individual structure and electrical device for detecting the pointer position are unnecessary.

What is claimed is:

1. An electronic clock, comprising:

reference signal generating means for generating a reference signal;

pulse control means for outputting a plurality of pulse signals whose strength is different based on said reference signal to a motor to drive the motor;

a wheel train which is rotated by said motor;

indicator means which is rotated by said wheel train;

position detecting means for detecting predetermined position of said indicator means; and rotation judging means for outputting a rotation signal or a non-rotation signal by detecting whether or not said motor rotates;

said electronic clock being characterized in that it is provided with high load means for applying high load to said wheel train at constant cycle to rotate said motor only when the high load is applied to said wheel train and a pulse signal of predetermined strength or more is outputted to said motor;

said pulse control means outputs a normal driving pulse, outputting a first auxiliary driving pulse whose strength is greater than that of said normal driving pulse when said rotation judging means outputs a non-rotation signal after outputting said normal driving pulse or outputting a second auxiliary driving pulse whose strength is greater than said first auxiliary driving pulse and said predetermined strength when said rotation judging means outputs the non-rotation signal after outputting said first auxiliary driving pulse; and said position detecting means judges that said indicator means is located at said predetermined position when said second auxiliary driving pulse is outputted.

2. The electronic clock as described in claim 1, characterized in that said position detecting means judges that said indicator means has come to said predetermined position when said rotation judging means outputs the non-rotation signal after outputting the first auxiliary driving pulse.

3. The electronic clock as described in claim 1, further comprising:

number-of-revolutions counting means for counting a number of revolutions of said motor since when said pulse control means has outputted said second auxiliary driving pulse for the first time; and number-of-revolutions judging means for outputting a control signal for outputting said second auxiliary driving pulse when said number of revolutions reaches to the number of revolutions corresponding to the cycle in which the high load is applied to the wheel train to said pulse control means.

4. The electronic clock as described in claim 3, further comprising:

pulse output times counting means for counting a number of output times of said second auxiliary driving pulse during when the number of revolutions of said motor reaches to the number-of-revolutions signal corresponding to the cycle in which the high load is applied to the wheel train; and pulse number judging means for outputting a control signal for stopping to generate said pulse signal to said pulse control means when the output times of the second auxiliary driving pulse exceeds a predetermined number of times.

5. The electronic clock as described in claim 3, further comprising:

pulse output times counting means for counting a number of output times of said second auxiliary driving pulse during when the number of revolutions of said motor reaches to the number-of-revolutions signal corresponding to the cycle in which the high load is applied to the wheel train; and pulse number judging means for outputting a control signal for changing output intervals of said pulse signal to said pulse control means when the output times of the second auxiliary driving pulse exceeds a predetermined number of times.

6. An electronic clock, comprising:

reference signal generating means for generating a reference signal;

pulse control means for outputting a plurality of pulse signals whose strength is different based on said reference signal to a motor to drive the motor;

a wheel train which is rotated by said motor;

indicator means which is rotated by said wheel train;

position detecting means for detecting predetermined position of said indicator means; and rotation judging means for outputting a rotation signal or a non-rotation signal by detecting whether or not said motor rotates;

said electronic clock being characterized in that it is provided with high load means for applying high load to said wheel train continuously by a plurality of times at constant cycle so that the motor rotates only when the high load is applied to said wheel train and a pulse signal of predetermined strength or more is outputted to said motor continuously by a plurality of times;

said pulse control means outputs a normal driving pulse, outputting a first auxiliary driving pulse whose strength is greater than that of said normal driving pulse when said rotation judging means outputs a non-rotation signal after outputting said normal driving pulse or outputting a second auxiliary driving pulse whose strength is greater than said first auxiliary driving pulse and said predetermined strength when said rotation judging means outputs the non-rotation signal after outputting said first auxiliary driving pulse; and said position detecting means judges that said indicator means is located at said predetermined position when said second auxiliary driving pulse is outputted continuously by a plurality of times and when said rotation judging means outputs the rotation signal as said normal driving pulse or first auxiliary driving pulse is outputted after that.

7. A pointer position detecting method for detecting that indicator means has come to predetermined position, comprising steps of:

applying high load to a wheel train for rotating said indicator means at constant cycle so that a motor rotates only when the high load is applied and a pulse signal of predetermined strength or more is outputted to the motor for rotating said wheel train;

judging whether or not said motor rotates by outputting a normal driving pulse to said motor;

judging whether or not said motor rotates by outputting a first auxiliary driving pulse whose strength is greater than that of the normal driving pulse to said motor when said motor does not rotate by the normal driving pulse;

outputting a second auxiliary driving pulse whose strength is greater than said first auxiliary driving pulse and said predetermined strength to said motor when said motor does not rotate by said first auxiliary driving pulse; and judging that said indicator means is located at said predetermined position when said second auxiliary driving pulse is outputted.

8. The pointer position detecting method as described in claim 7, characterized in that said indicator means is judged to be located at said predetermined position when said motor does not rotate by said first auxiliary driving pulse.

9. The pointer position detecting method as described in claim 7, characterized in that a number of revolutions of said motor is counted and said second auxiliary driving pulse is outputted when the number of revolutions reaches to a number of revolutions corresponding to the cycle in which high load is applied to the wheel train.

10. The pointer position detecting method as described in claim 9, characterized in that a number of output times of said second auxiliary driving pulse is counted during when the number of revolutions of said motor reaches to the number of revolutions corresponding to the cycle in which the high load is applied to the wheel train to stop to generate said pulse signal when the number of output times exceeds a predetermined number of times.

11. The pointer position detecting method as described in claim 9, characterized in that a number of output times of said second auxiliary driving pulse is counted during when the number of revolutions of said motor reaches to the number of revolutions corresponding to the cycle in which the high load is applied to the wheel train to change output intervals of said pulse signal when the number of output times exceeds a predetermined number of times.

12. A pointer position detecting method for detecting that indicator means has come to predetermined position, comprising steps of:

applying high load to a wheel train for rotating said indicator means continuously by a plurality of times at constant cycle so that a motor rotates only when the high load is applied and a pulse signal of predetermined strength or more is outputted to the motor for rotating said wheel train;

judging whether or not said motor rotates by outputting a normal driving pulse to said motor;

judging whether or not said motor rotates by outputting a first auxiliary driving pulse whose strength is greater than that of the normal driving pulse to said motor when said motor does not rotate by the normal driving pulse;

outputting a second auxiliary driving pulse whose strength is greater than said first auxiliary driving pulse and said predetermined strength to said motor when said motor does not rotate by said first auxiliary driving pulse; and judging that said indicator means is located at said predetermined position when said second auxiliary driving pulse is outputted continuously by a plurality of times and said motor rotates when said normal driving pulse or first auxiliary driving pulse is outputted after that.

* * * * *